United States Patent [19]

Wolf

[11] 4,304,290

[45] Dec. 8, 1981

[54] METHOD OF ADJUSTING THE SETTING SPEED OF THE NARROW SIDES OF PLATE MOLDS

[75] Inventor: Manfred Wolf, Zurich, Switzerland

[73] Assignee: Concast AG, Zurich, Switzerland

[21] Appl. No.: 176,706

[22] Filed: Aug. 11, 1980

[30] Foreign Application Priority Data

Sep. 21, 1979 [CH] Switzerland ..... 8564/79

[51] Int. Cl.[3] ..... B22D 11/16

[52] U.S. Cl. ..... 164/452; 164/491

[58] Field of Search ..... 164/4, 154, 82, 436

[56] References Cited

U.S. PATENT DOCUMENTS

| | | | |
|---|---|---|---|
| 3,886,991 | 6/1975 | Meier et al. | 164/4 |
| 4,105,059 | 8/1978 | Ohnishi et al. | 164/4 |
| 4,134,441 | 1/1979 | Ohmori et al. | 164/4 |

FOREIGN PATENT DOCUMENTS

| | | |
|---|---|---|
| 2340768 | 2/1974 | Fed. Rep. of Germany . |
| 2550012 | 5/1976 | Fed. Rep. of Germany . |
| 558687 | 2/1975 | Switzerland . |

*Primary Examiner*—Robert D. Baldwin
*Assistant Examiner*—K. Y. Lin
*Attorney, Agent, or Firm*—Werner W. Kleeman

[57] ABSTRACT

The narrow sides or side walls of a plate mold are adjusted or set, during continuous casting, while increasing their mutual spacing from one another in order to increase the sectional shape or format of the continuously cast strand. The withdrawn heat of the narrow sides of the mold is measured and used as a control magnitude for setting the adjustment speed of such narrow sides of the mold.

3 Claims, No Drawings

METHOD OF ADJUSTING THE SETTING SPEED OF THE NARROW SIDES OF PLATE MOLDS

BACKGROUND OF THE INVENTION

The present invention relates to a new and improved method of setting or adjusting the adjustment of speed of the narrow sides or side walls of a plate mold during the continuous casting of metals, especially steel, wherein during the continuous casting operation there is increased the spacing between the narrow sides of the mold.

It is already known to the art to alter during the continuous casting operation the position of the mold walls of a plate mold, especially the narrow sides of the mold, and thus, to undertake a change in both the format or sectional shape of the cast strand or casting as well as an adjustment of the taper of the mold. In order to however make the length of the transition section or piece of the cast strand as short as possible—in other words the part of the strand between the initially cast sectional shape or format and the sectional shape which is to be newly cast—and to thus hold the losses in strand material to a minimum, it is necessary that the mold wall adjustment speed be selected as great as possible. But in so doing there exists the danger, particularly during adjustment of the mold walls towards the outside, that there will be formed at the strand bow-out and metal break-out phenomena.

It is also further known to positionally adjust the narrow sides of a plate mold, while changing their mutual spacing, at a speed of at most 2 millimeters per second in order to cast strands in the form of slabs. However, there is no teaching as to the manner and with what speed the adjustment is in fact to take place. Thus, it appears that disturbances, such as for instance metal break-out, also can arise within this indicated speed range.

Also there is known to the art a method of controlling the cooling capacity of the narrow side walls of plate molds during continuous casting as the same has been taught in Swiss Pat. No. 558,687. Here, before the start of casting the taper of the continuous casting mold is adjusted to a reference value which is accomodated to the contemplated casting speed and/or the casting temperature and during changes in the casting speed and/or the casting temperature during the casting operation there is adjusted the taper. To this end, the mold is provided with devices for measuring the cooling capacity or efficiency at the narrow side walls and with adjustment devices for the narrow sides of the mold.

SUMMARY OF THE INVENTION

It is a primary object of the present invention to provide a new and improved method of adjusting the setting or adjustment speed of the narrow sides of a plate mold in a manner which is not associated with the aforementioned drawbacks and limitations of the prior art proposals.

It is another and more specific object of the present invention to provide a new and improved method of adjusting or setting the adjustment speed of the narrow sides of a plate mold, especially for casting sectional shapes of rectangular configuration or shape, which enables maintaining the transition piece or section of the cast strand small, but however enables accomplishing the adjustment towards the outside in a positive manner during the continuous casting operation and without negative affects, such as for instance bow-out of the strand and metal break-out.

Now in order to implement these and still further objects of the invention, which will become more readily apparent as the description proceeds, the method of the invention contemplates measuring the quantity of heat withdrawn at the narrow sides of the mold during their displacement or adjustment and adjusting the narrow sides only so rapidly that the withdrawn quantity of heat does not fall below a predetermined value.

DETAILED DESCRIPTION OF THE PREFERRED EMBODIMENTS

Describing now the invention in detail, it is to be understood that by virtue of the inventive method it is possible to adjust the narrow sides of the mold towards the outside to a new larger sectional shape or format, during the continuous casting operation, without any disadvantageous consequences and at an optimum speed or velocity. Under the term "during the continuous casting operation" there is to understood that during the adjustment of the narrow sides of the mold for the purpose of enlarging the strand sectional shape of format, there occurs an inflow of metal, typically steel, into the plate mold from the forwardly arranged casting vessel, typically the tundish. The aforementioned predetermined value or magnitude of the quantity of heat which is to be withdrawn is chosen such that through adequate contact of the strand skin at the mold wall such strand skin is of sufficient strength at the exit end of the casting mold that there can be effectively avoided bowing-out of the strand and metal break-out, because by virtue of the measurement of the quantity of heat withdrawn at the narrow side walls of the mold during the adjustment such measured quantity is an indicator as to the contact of the narrow strand sides of the formed strand or casting at the mold walls, and thus, for the growth of the strand skin within the continuous casting mold.

This magnitude or value advantageously amounts to $$H \geqq \frac{6000}{t^{0.5}} \cdot \left( \frac{1+B}{1-B} \right),$$

wherein in the foregoing H represents the quantity of heat to be withdrawn related to the strand surface in the mold (in kcal·m$^{-2}$), the number 6000 is an empirically determined constant (in kcal·min$^{0.5}$19 m$^{-2}$) and t represents the residence time (in min.) of a strand segment of element and B represents the width of the narrow side (in meters). The aforementioned residence time is computed from the effective mold length L (in meters) divided by the casting speed or velocity V (in meters·min$^{-1}$). As the effective mold length L (in meters) there is to be understood the length of the steel molten level or meniscus in the mold to the exit end of the mold. Since both the mold length L and also the casting speed V are known, it is a simple matter to compute the advantageous quantity of heat which is to be withdrawn.

The adjustment or setting of the adjustment speed of the narrow sides of the plate mold can be carried out completely automatically. Devices for the determination of the actually removed heat quantities are well known in this technology as are also devices for the adjustment of the narrow sides of the mold. The obtained actual value signal of the removed quantity of heat at the narrow sides of the mold can be compared with the reference value signal corresponding to the quantity of heat which is to be removed, and the resultant output signal can be employed for controlling the adjustment speed of the narrow sides of the continuous casting mold.

It is to be understood that the method of the invention can likewise be beneficially employed for the setting or adjustment of the adjustment speed of only one of both of the oppositely situated narrow sides of the plate mold, in which case then there is used as the control magnitude only the heat output measurement of the moved mold side wall or side.

While there have been described present preferred embodiments of the invention, it is to be distinctly understood that the invention is not limited thereto, but may be practiced otherwise while employing the basic concepts of the invention and within the scope of the following claims. ACCORDINGLY,

What I claim is:

1. A method of adjusting the setting speed of the narrow sides of a plate mold during the continuous casting of a metal, comprising the steps of:

moving at least one narrow side wall of the plate mold towards the outside during the continuous casting operation in order to increase the spacing between the narrow sides of the continuous casting mold;

measuring the quantity of heat which is withdrawn at said at least one narrow side wall during its adjustment; and adjusting said at least one narrow side wall of the plate mold only at such a speed that the quantity of heat which is withdrawn does not fall below a predetermined magnitude.

2. The method as defined in claim 1, wherein:

the case metal is steel; and said predetermined magnitude of withdrawn heat satisfies the relationship $$H \geqq \frac{6000}{t^{0.5}} \cdot \left( \frac{1 + B}{1 - B} \right)$$

wherein t represents the residence time (in minutes) of a strand element in the continuous casting mold, the number 6000 is a constant (in $kcal \cdot min^{0.5} \cdot m^{-2}$) and B represents the width of the narrow side (in meters) of the plate mold.

3. The method as defined in claim 1, further including the steps of:

moving both of the narrow side walls of the plate mold;

measuring individually the quantity of heat withdrawn at both of the narrow side walls during their adjustment; and adjusting both of the narrow side walls of the plate mold at such a speed that the withdrawn quantity of heat of each narrow side wall does not fall below said predetermined magnitude.

* * * * *